US006314689B1

(12) United States Patent
Hughes

(10) Patent No.: US 6,314,689 B1
(45) Date of Patent: Nov. 13, 2001

(54) TRANSPARENT PLANAR STORM SHIELD

(76) Inventor: John A. Hughes, 24065 Roger Dodger St., Bonita Spring, FL (US) 34135-6759

( * ) Notice: Subject to any disclaimer, the term of this patent is extended or adjusted under 35 U.S.C. 154(b) by 0 days.

(21) Appl. No.: 09/617,768

(22) Filed: Jul. 17, 2000

(51) Int. Cl.[7] ..... E06B 3/30
(52) U.S. Cl. ..... 52/203; 52/456
(58) Field of Search ..... 52/202, 203, 204.61, 52/656, 656.5, 656.6, 656.7, 456

(56) References Cited

U.S. PATENT DOCUMENTS

| | | | | |
|---|---|---|---|---|
| 3,006,041 | * | 10/1961 | Thuet et al. | 52/203 |
| 4,702,055 | * | 10/1987 | Ralph | 52/456 |
| 5,040,347 | * | 8/1991 | Valvis | 52/456 X |
| 5,291,710 | * | 3/1994 | Golen | 52/456 X |
| 5,351,459 | * | 10/1994 | Kassl et al. | 52/456 X |
| 5,477,647 | * | 12/1995 | Yates | 52/204.61 X |
| 5,722,206 | * | 3/1998 | McDonald | 52/202 |
| 5,911,660 | * | 6/1999 | Watson | 52/202 |
| 6,026,621 | * | 2/2000 | Fisher | 52/456 X |
| 6,079,168 | * | 6/2000 | Shaver | 52/202 |

* cited by examiner

*Primary Examiner*—David M. Purol
(74) *Attorney, Agent, or Firm*—Merrill N. Johnson

(57) ABSTRACT

A transparent planar storm shield has framed panels (1, 2, 12) with predetermined transparency and predetermined resistance to storm pressure and to storm-debris impact. Panels (3, 9, 10) of the framed panels are preferably shatter-proof plastic material that includes predetermined polycarbonate. Frames (4, 5, 6, 7, 13) of the framed panels have strengths in proportion to thicknesses for predetermined storm protection by predetermined areas of the storm shield. The storm shield is a cover of a predetermined portion of a building orifice which can include a door or a window. The predetermined resistance to storm pressure and to storm-debris impact of the panels is about an equivalent to a commercial grade of polycarbonate or an equivalent thereof that is twenty-five inches square with a thickness of one-eighth of an inch and being rectangular with less than twenty-five percent deviation from being square. Strengths of the frames are predetermined by capacity to contain the panels in positions of resistance to the predetermined resistance to the storm pressure and the storm-debris impact.

9 Claims, 4 Drawing Sheets

FIG. 1
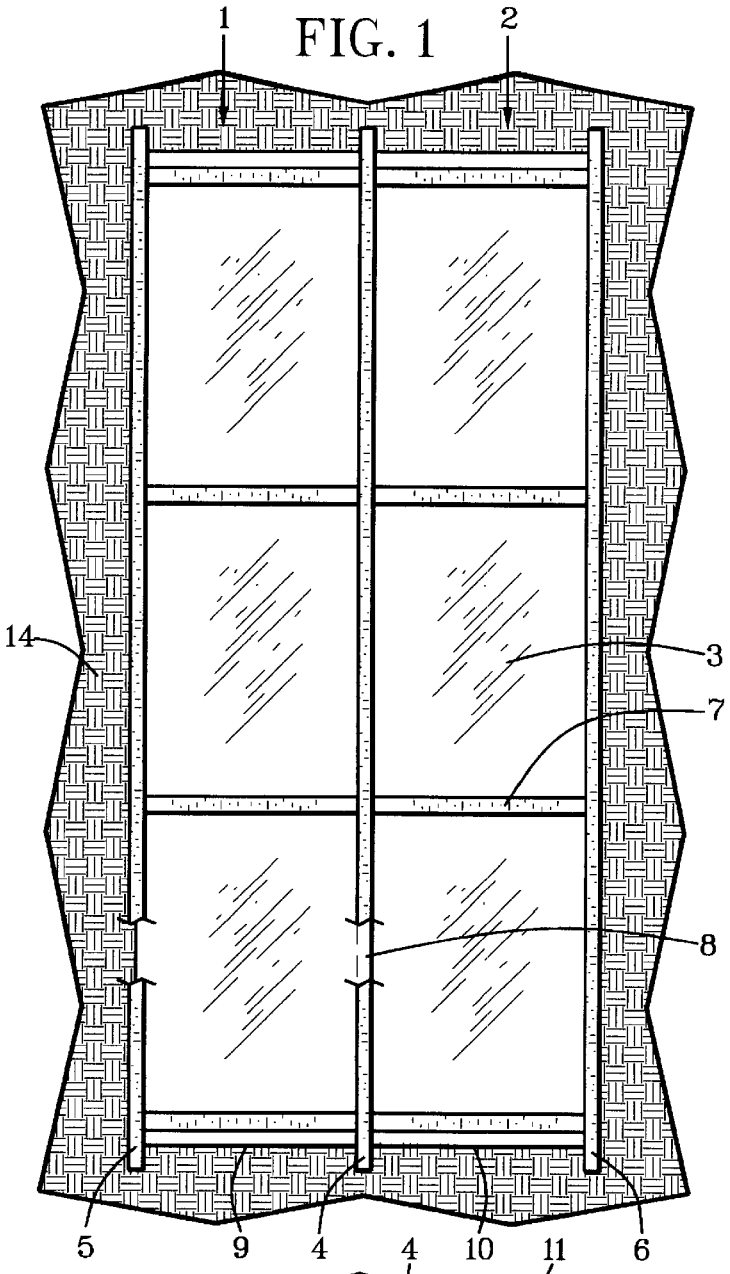
FIG. 2
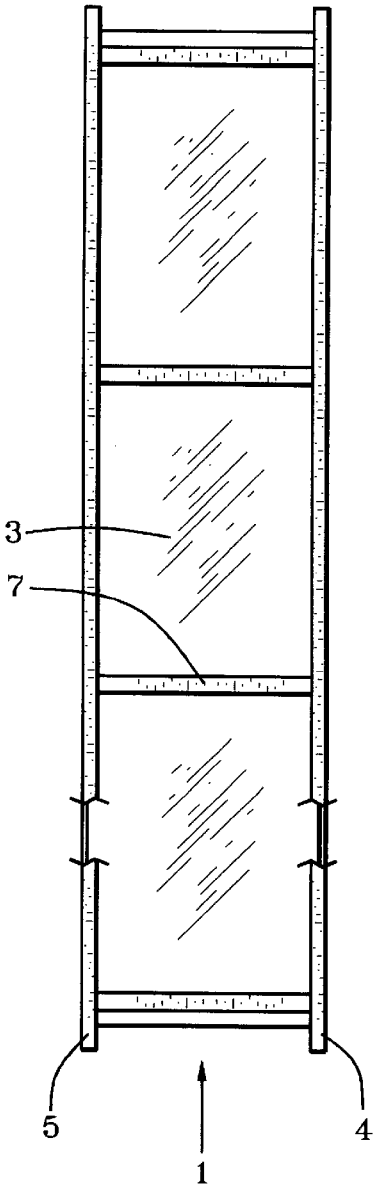
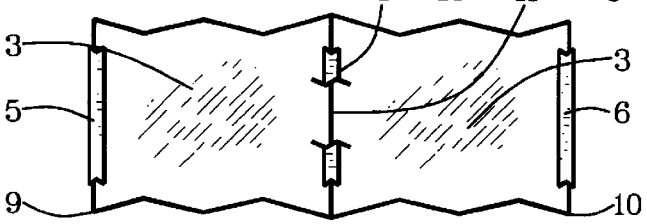
FIG. 3

TRANSPARENT PLANAR STORM SHIELD

FIELD OF THE INVENTION

1. Field of the Invention.

This invention relates to hurricane and other storm shields of orifices in buildings.

BACKGROUND OF THE INVENTION

2. Relation to prior art.

Designs and structures of storm shields proliferated after recent hurricane damages and resulting laws for protection against damages from future storms and natural disasters. None are known, however, to be flat, transparent panels that are attachable and storable in a manner taught by this invention.

Examples of most-closely related known but yet different storm shields are described in the following patent documents. U.S. Pat. No. 5,918,430, issued to Rowland on Jul. 6, 1999, described a removable storm shield having a convex structure to deflect wind pressures outwardly. U.S. Pat. No. 5,852,903, issued to Astrizky on Dec. 29, 1998, described a hurricane shutter that folded over a window or door. U.S. Pat. No. 5,487,243, issued to Hale et al on Jan. 30, 1996, described a storm shutter system having reinforcement panels that fit flush against window and door panels. U.S. Pat. No. 5,228,238, issued to Fenkell on Jul. 20, 1993, described a transparent storm shutter that bowed and hinged resiliently against storm pressures to protect windows and doors. U.S. Pat. No. 4,685,261 issued to Seaquist on Aug. 11, 1987, was limited to a storm shutter having a frame with a base having an adjustable base angle to fit onto a wide range of window sills.

SUMMARY OF THE INVENTION

Objects of patentable novelty and utility taught by this invention are to provide a transparent planar storm shield which:

- provides window and door structure which obviates need for hurricane shutters and other extraneous or added protection against hurricane wind forces and impact by hurricane debris;
- is adaptable to a wide selection of sizes, shapes and aesthetics of windows and doors;
- provides protection against unlawful entry by glass-breakage; and
- makes doors and windows hurricane-proof inexpensively and aesthetically adaptable without need for extra protection against both hurricane-level storms and most criminal breaking and entry through doors and windows.

This invention accomplishes these and other objectives with a transparent planar storm shield having framed panels with predetermined transparency and predetermined resistance to storm pressure and to storm-debris impact. Panels of the framed panels are preferably shatterproof plastic material that includes predetermined polycarbonate. Frames of the framed panels have strengths in proportion to thicknesses for predetermined storm protection by predetermined areas of the storm shield. The storm shield is a predetermined portion of a building orifice which can include a door or a window. The predetermined resistance to storm pressure and to stormdebris impact of the panels is about an equivalent to a commercial grade of polycarbonate having a thickness of one-eighth of an inch and being rectangular with less than twenty-five percent deviation from being square. Strengths of the frames are predetermined by capacity to contain the panels in positions of resistance to the predetermined resistance to the storm pressure and the storm-debris impact.

BRIEF DESCRIPTION OF DRAWINGS

This invention is described by appended claims in relation to description of a preferred embodiment with reference to the following drawings which are explained briefly as follows:

FIG. 1 is a partially cutaway front elevation view of a transparent planar storm shield having two multiple-frame panels on a building side of frames;

FIG. 2 is a partially cutaway front elevation view of a transparent planar storm shield having one multiple-frame panel on a building side of frames;

FIG. 3 is a partially cutaway portion of two multiple-frame panels that are juxtaposed instead of overlapped;

DESCRIPTION OF PREFERRED EMBODIMENT

Figure 4:
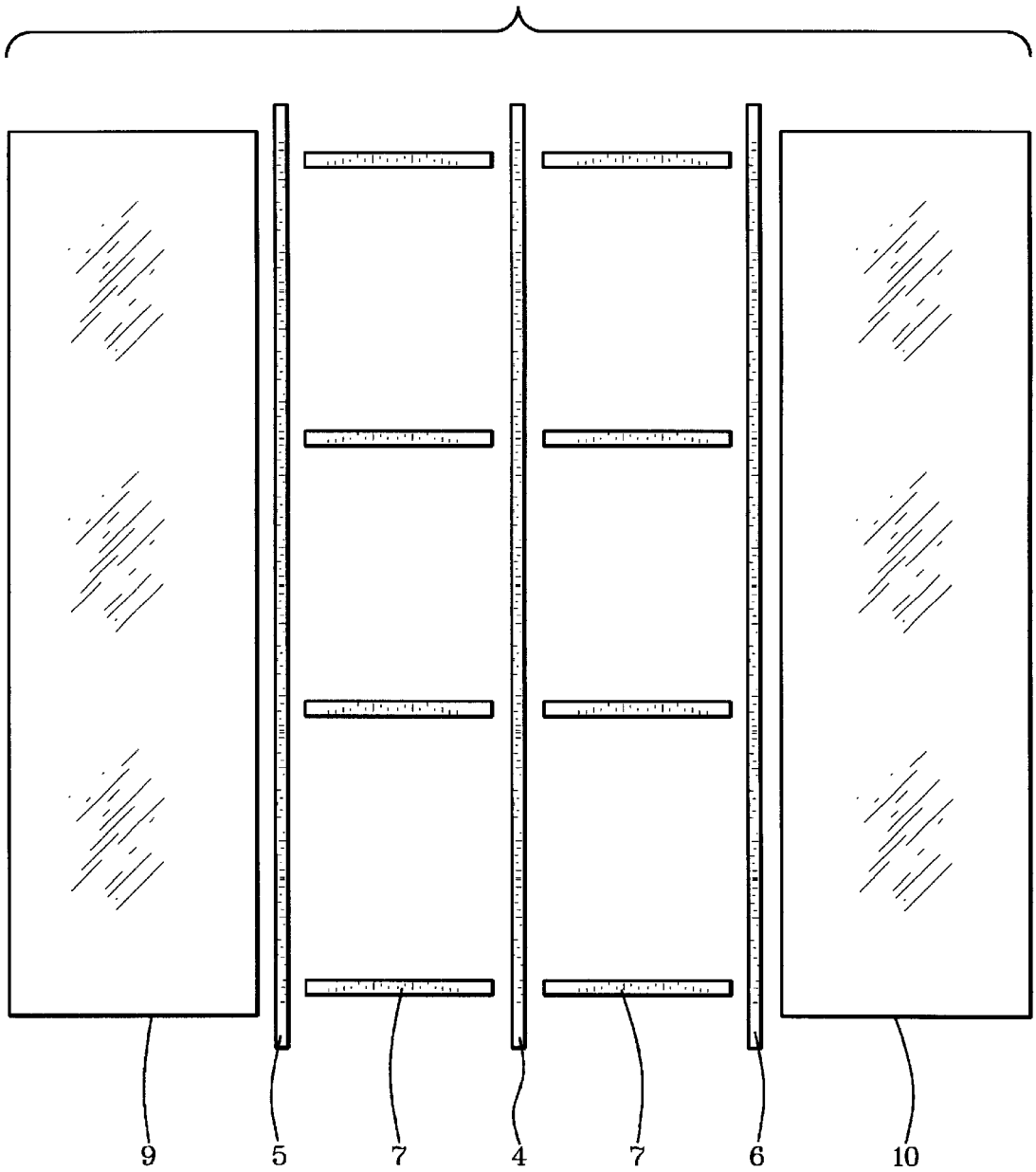
FIG. 4 is an exploded front elevation view.
Figure 5:
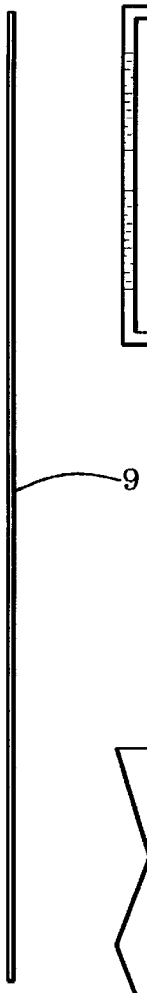
FIG. 5 is a side view of a panel.

Listed numerically below with reference to the drawings are terms used to describe features of this invention. These terms and numbers assigned to them designate the same features throughout this description.

1. First multiple-frame panel
2. Second multiple-frame panel
3. Panel section
4. First vertical-edge support
5. Second vertical-edge support
6. Third vertical-edge support
7. Horizontal support
8. Overlap
9. First panel
10. Second panel
11. Abutment sides
12. Single-frame panel
13. Single-panel frame
14. Building structure
15. Aluminum tubing
16. Tube edges
17. Tube sides
18. Fasteners
19. Fastener brackets Referring first to FIGS. 1–6, a framed panel which includes a first multiple-frame panel 1 and a second multiple-frame panel 2 has pluralities of panel sections 3 that are framed by a first vertical-edge support 4, a second vertical-edge support 5, a third vertical-edge support 6 and eight horizontal supports 7 as shown in FIG. 1.

As shown in FIG. 2, a framed panel which includes the first vertical-edge support 4 and the second vertical-edge support 5 to frame the first multiple-frame panel 1 has a plurality of three of the panel sections 3 between four of the horizontal supports 7.

As shown in FIG. 1, the panel sections 3 are framed portions of multiple-frame panels which can be positioned side-by-side linearly with an overlap 8 of a first panel 9 approximately two inches over a second panel 10.

Optionally as shown in FIG. 3, the first panel 9 and the second panel 10 can be juxtaposed side-by-side proximate abutment sides 11 without the overlap 8.

Figure 6:
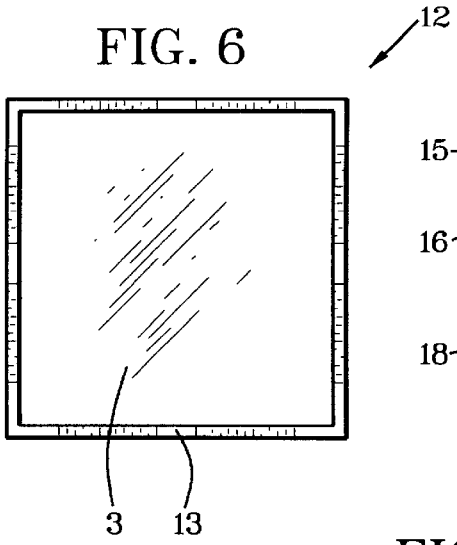
FIG. 6 is a front view of square single-frame panel.

The framed panel, whether a multiple-frame panel such as the first multiple frame panel 1, the second multiple-frame panel 2 shown in FIGS. 1–5 or a single-frame panel 12 shown in FIG. 6, has predetermined transparency and predetermined resistance to storm pressure and storm-debris impact. The panels are a shatterproof material having predetermined toughness and resilience. The storm-pressure resistance and the storm-debris-impact resistance approximate, within at least ninety percent, the storm-pressure resistance and storm-debris-impact resistance of a twenty-five-inch-square sheet of predetermined standard polycarbonate having a thickness of one-eighth of an inch and being supported rigidly along four edges of the sheet.

Figure 7:
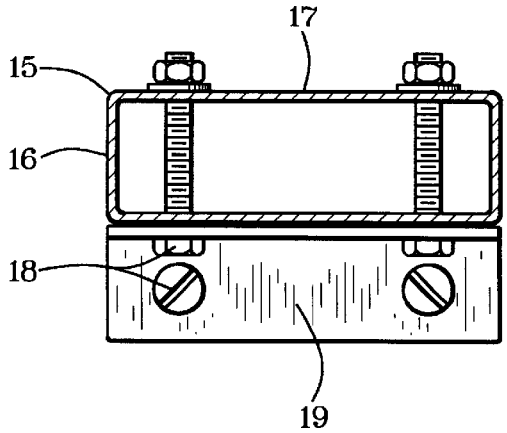
FIG. 7 is an enlarged end view of an extruded aluminum-tube frame member.
Figure 8:
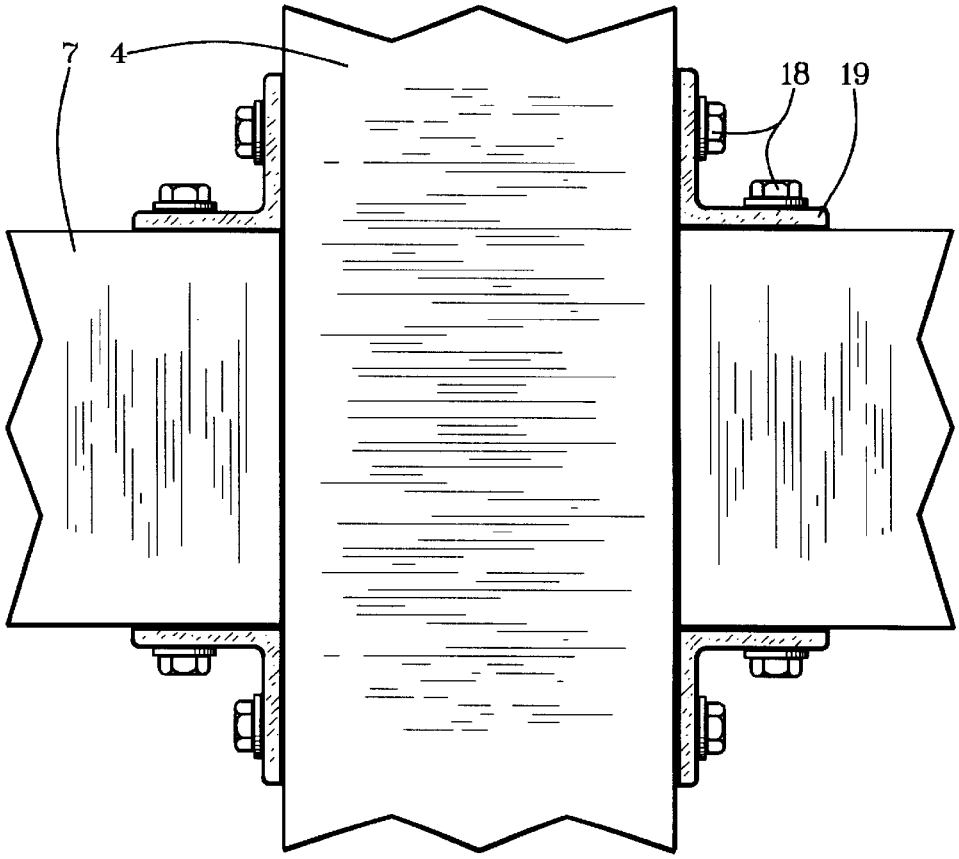
FIG. 8 is an enlarged intersection of a vertical-edge support and two horizontal supports.
Figure 9:
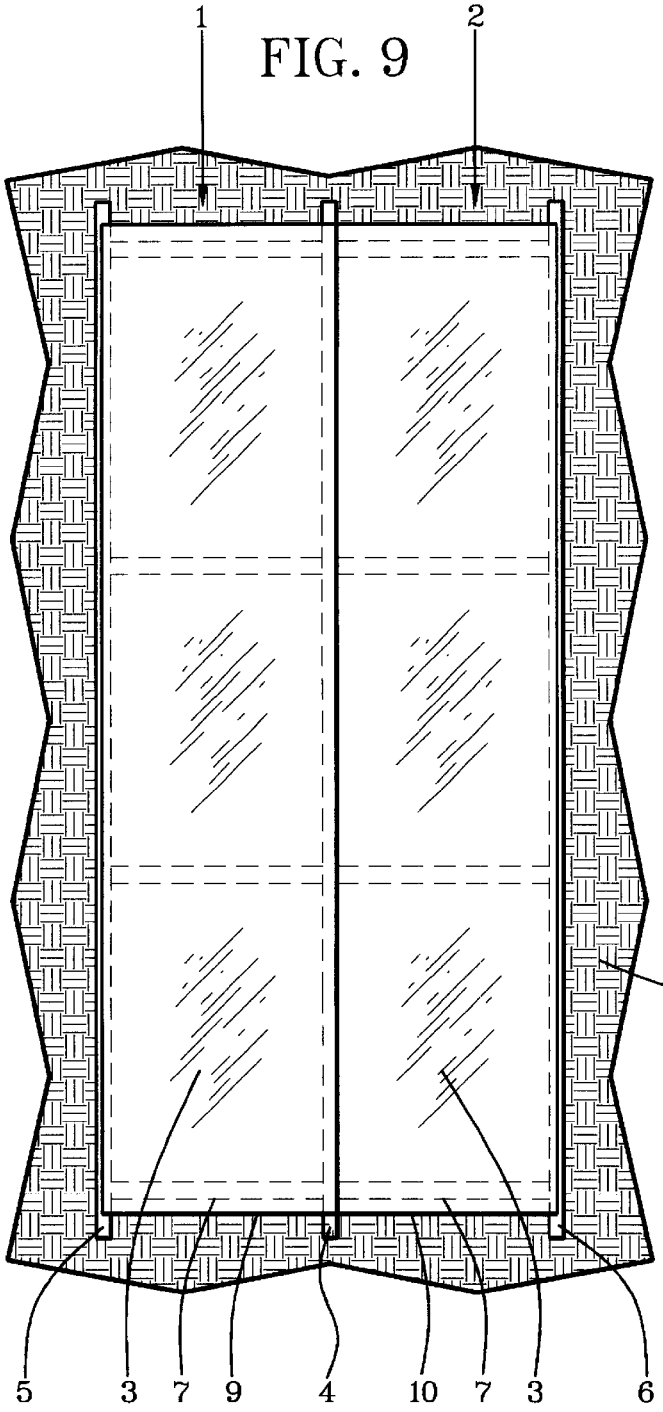
FIG. 9 is a partially cutaway front elevation view of a transparent planar storm shield having multiple-frame panels opposite a building side of frames.
Figure 10:
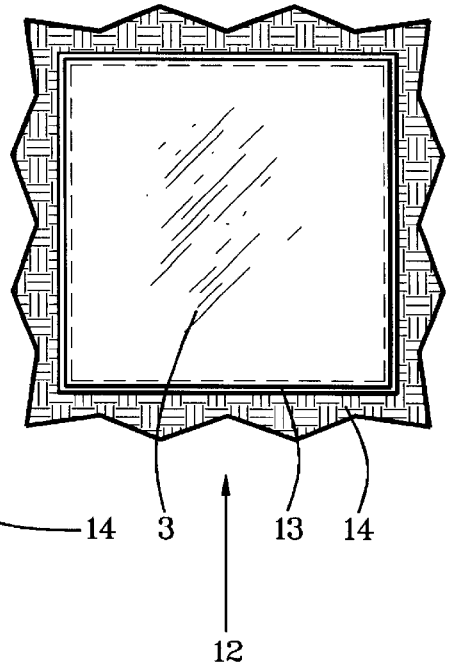
FIG. 10 is a front view of a square single-frame panel opposite a building side of a frame.

A frame of the framed panel, however structured, has structural capacity to contain the panels 9, 10 and/or 12 or an equivalent thereof, in a position of the predetermined resistance to the storm pressure and to the storm-debris impact. The frame, which can include the first vertical-edge support 4, the second vertical-edge support 5, the third vertical-edge support 6, the horizontal supports 7 and a single-panel frame 13, can be supported by or adapted to building structure 14 proximate a building orifice which can include a door or a window. The building structure 14 and framing with framing components 4–7 and 13 are determined by and adapted to the predetermined resistance to the storm pressure and to the storm-debris impact of the panels 9, 10 and/or 12 or an equivalent thereof Optionally as shown in FIGS. 9–10, the frame in position against the building structure 14 can support the panels 9, 10 and/or 12 or an equivalent thereof As depicted in FIGS. 7–8, framing components to support the storm-debris impact of the panels 9, 10 and/or 12 or an equivalent thereof can include the three vertical-edge supports 4–6, the horizontal supports 7 and the single-panel frame 13 having structural capacity of rectangular extrusions of 6063 T5 aluminum tubing 15 having walls one-eighth inch thick at tube edges 16 that are one inch long and at tube sides 17 that are three inches long. Preferred fasteners 18 and fastener brackets 19 for the aluminum tubing 15 are shown. Equivalent plastic and other framing materials are optional.

The twenty-five-inch square sheet of predetermined polycarbonate is represented squarely by the single-frame panel 12 in FIGS. 6 and 10 and rectangularly in FIGS. 1–2 and 9. The square and the rectangular representations have within ninety percent of the same square area for being within the predetermined storm-pressure resistance and storm-debris-impact resistance. Accordingly, the square single-frame panel 12 of FIGS. 6 and 10 has sides twenty-five inches long and rectangular multiple-frame panels 1 and 2 of FIGS. 1–2 and 9 have long sides thirty inches long and short sides 21–23 inches long intermediate frame members. The first panel 9 and the second panel 10 are twenty-four inches wide and ninety-six inches long as cut from one-eight-inch thick sheets of predetermined polycarbonate which are four feet wide and eight feet long. The aluminum tubing 15 for the vertical-edge supports 4–6 is one-hundred-and-two inches long. The aluminum tubing 15 for the horizontal supports 7 is 21 and to 23 inches long for the overlapped framework in FIG. 1 and for the juxtaposed framework in FIG. 3 respectively.

The twenty-five-inch-square sheet of the panel sections 3 can be increased up to two-hundred percent with four-hundred percent increase in the one-eighth-inch thickness of the panel sections 3 for up-size scaling. Down-size scaling is not reliable because of minimum thickness requirements.

The predetermined polycarbonate is the predominate grade currently available generally at building and hardware outlets.

This invention teaches structural and working relationship of parts and materials with known materials for reliable and inexpensive stormproof doors and windows without need for shutters or other extraneous storm protection.

A new and useful transparent planar storm shield having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A transparent planar storm shield comprising:

at least one framed panel having predetermined transparency and predetermined resistance to storm pressure and to storm-derbis impact;

a panel of the framed panel is a shatterproof plastic material having predetermined toughness and resilience;

the panel has storm-pressure resistance and storm-debris-impact resistance that approximate within at least ninety percent the storm-pressure resistance and storm-debris-impact resistance of a twenty-five-inch-square sheet of a predetermined polycarbonate or an equivalent thereof having a thickness of one-eighth of an inch and being supported rigidly along four edges of the sheet;

a frame of the framed panel has structural capacity proximate structural capacity to contain the panel in a position of the predetermined resistance to the storm pressure and to the storm-debris impact; and the storm shield is a cover of a predetermined portion of a building orifice which includes a door or a window the at least one framed panel includes at least one multiple-frame panel having a plurality of panel sections; and the panel sections are framed by a matching plurality of frames having the structural capacity to contain the panel sections in positions of the predetermined resistance to the storm pressure and to the storm-debris impact the multiple-frame panel has a length proximate ninety-six inches and a width proximate twenty-four inches;

the frames include two vertical-edge supports approximately one-hundred-and-two inches long;

the two vertical-edge supports are oppositely disposed on side edges of the multiple-frame panel;

the frames include four horizontal supports approximately twenty-one inches long;

the horizontal supports are positioned intermediate the two vertical-edge supports at approximately thirty-inch intervals; and the multiple-frame panel has four of the panel sections that are rectangular with exposed surfaces having widths of approximately twenty-one inches and heights of approximately thirty inches intermediate the two vertical-edge supports the at least one multiple-frame panel having a plurality of panel sections includes two multiple-frame panels having pluralities of panel sections;

the two multiple-frame panels have lengths proximate ninety-six inches and widths proximate twenty-four inches;

the two multiple-frame panels are positioned side-by-side linearly with an overlap of a first panel of the two multiple-frame panels approximately two inches over a second panel of the two multiple-frame panels;

the frames include three vertical-edge supports approximately one-hundred-and-two inches long;

a first vertical-edge support of the three vertical-edge supports is positioned on the overlap of overlap sides of the two multiple-frame panels;

a second vertical-edge support of the three vertical-edge supports is positioned on a non-overlap side of the first panel;

a third vertical-edge support of the three vertical-edge supports is positioned on a non-overlap side of the second panel;

the frames include eight horizontal supports approximately twenty-one inches long;

a first four of the horizontal supports are positioned intermediate the first vertical-edge support and the second vertical-edge support at approximately thirty-inch intervals;

a second four of the horizontal supports are positioned intermediate the first vertical-edge support and the third vertical-edge support at approximately thirty-inch intervals;

a first multiple-frame panel of the two multiple-frame panels has three of the panel sections that are rectangular with exposed surfaces having widths of approximately twenty-one inches and heights of approximately thirty inches intermediate the first vertical-edge support and the second vertical-edge support; and a second multiple-frame panel of the two multiple-frame panels has three of the panel sections that are rectangular with exposed surfaces having widths of approximately twenty-one inches and heights of approximately thirty inches intermediate the first vertical-edge support and the third vertical-edge support.

2. The transparent planar storm shield of claim 1, wherein:

the three vertical-edge supports and the eight horizontal supports of the panel sections have structural capacity of rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

3. The transparent planar storm shield of claim 1, wherein:

the three vertical-edge supports and the eight horizontal supports of the panel sections are rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

4. A transparent planar storm shield comprising:

two multiple-frame panels having pluralities of panel sections with predetermined transparency and predetermined resistance to storm pressure and to storm-debris impact;

the two multiple-frame panels being shatterproof plastic material having predetermined toughness and resilience;

the two multiple-frame panels having storm-pressure resistance and storm-debris-impact resistance proximate storm-pressure resistance and storm-debris-impact resistance of a twenty-five-inch-square sheet of predetermined polycarbonate having a thickness of one-eighth of an inch and being supported rigidly along four edges of the sheet;

the two multiple-frame panels having lengths proximate ninety-six inches and widths proximate twenty-four inches;

the two multiple-frame panels being positioned side-by-side linearly with an overlap of a first panel of the two multiple-frame panels approximately two inches over a second panel of the two multiple-frame panels;

the two multiple-frame panels being framed by frames which include three vertical-edge supports approximately one-hundred-and-two inches long;

a first vertical-edge support of the three vertical-edge supports is positioned on the overlap of overlap sides of the two multiple-frame panels;

a second vertical-edge support of the three vertical-edge supports is positioned on a non-overlap side of the first panel;

a third vertical-edge support of the three vertical-edge supports is positioned on a non-overlap side of the second panel;

the frames include eight horizontal supports approximately twenty-one inches long;

a first four of the horizontal supports being positioned intermediate the first vertical-edge support and the second vertical-edge support at approximately thirty-inch intervals;

a second four of the horizontal supports being positioned intermediate the first vertical-edge support and the third vertical-edge support at approximately thirty-inch intervals;

a first multiple-frame panel of the two multiple-frame panels having three of the panel sections that are rectangular with exposed surfaces having widths of approximately twenty-one inches and heights of approximately thirty inches intermediate the first vertical-edge support and the second vertical-edge support; and a second multiple-frame panel of the two multiple-frame panels having three of the panel sections that are rectangular with exposed surfaces having widths of approximately twenty-one inches and heights of approximately thirty inches intermediate the first vertical-edge support and the third vertical-edge support.

5. The transparent planar storm shield of claim 4, wherein:

the three vertical-edge supports and the eight horizontal supports of the panel sections have structural capacity of rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

6. The transparent planar storm shield of claim 4, wherein:

the three vertical-edge supports and the eight horizontal supports of the panel sections are rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

7. A transparent planar storm shield comprising:

two multiple-frame panels having pluralities of panel sections;

the two multiple-frame panels being a cover of a predetermined portion of a building orifice which includes a door or a window;

the two multiple-frame panels having lengths proximate ninety-six inches and widths proximate twenty-four inches;

the two multiple-frame panels being positioned side-by-side linearly with an overlap of a first panel of the two multiple-frame panels approximately two inches over a second panel of the two multiple-frame panels;

the two multiple-frame panels being shatterproof plastic material having predetermined toughness and resilience;

the two multiple-frame panels having predetermined transparency and predetermined resistance to storm pressure and to storm-debris impact resistance of a twenty-five-inch-square sheet of predetermined polycarbonate having a thickness of one-eighth of an inch and being supported rigidly along four edges of the sheet;

a frame of the two multiple-frame panels having structural capacity proximate structural capacity to contain the two multiple-frame panels in positions of the predetermined resistance to the storm pressure and to the storm-debris impact;

the two multiple-frame panels having two panels with lengths proximate ninety-six inches and widths proximate twenty-four inches;

the two panels being positioned side-by-side linearly with an overlap of a first panel of the two panels approximately two inches over a second panel of the two panels;

the frame includes three vertical-edge supports approximately one-hundred-and-two inches long;

a first vertical-edge support of the three vertical-edge supports is positioned on the overlap of overlap sides of the two panels;

a second vertical-edge support of the three vertical-edge supports is positioned on a non-overlap side of the first panel;

a third vertical-edge support of the three vertical-edge supports is positioned on a non-overlap side of the second panel;

the frame includes eight horizontal supports approximately twenty-one inches long;

a first four of the horizontal supports being positioned intermediate the first vertical-edge support and the second vertical-edge support at approximately thirty-inch intervals;

a second four of the horizontal supports being positioned intermediate the first vertical-edge support and the third vertical-edge support at approximately thirty-inch intervals;

a first multiple-frame panel of the two multiple-frame panels having three of the panel sections that are rectangular with exposed surfaces having widths of approximately twenty-one inches and heights of approximately thirty inches intermediate the first vertical-edge support and the second vertical-edge support; and a second multiple-frame panel of the two multiple-frame panels having three of the panel sections that are rectangular with exposed surfaces having widths of approximately twenty-one inches and heights of approximately thirty inches intermediate the first vertical-edge support and the third vertical-edge support.

8. The transparent planar storm shield of claim 7, wherein:

the three vertical-edge supports and the eight horizontal supports of the panel sections have structural capacity of rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

9. The transparent planar storm shield of claim 7, wherein:

the three vertical-edge supports and the eight horizontal supports of the panel sections are rectangular extrusions of 6063 T5 aluminum tubing having walls one-eighth inch thick, heights of one inch and widths of three inches to contain the two multiple-frame panels in positions of the predetermined resistance to the storm pressure and to the storm-debris impact.

* * * * *